US006833501B2

(12) United States Patent
Jagmin

(10) Patent No.: US 6,833,501 B2
(45) Date of Patent: Dec. 21, 2004

(54) ACOUSTIC GUITAR ASSEMBLY

(76) Inventor: Timothy K. Jagmin, 880 Marge-ann Dr., Traverse City, MI (US) 49684

( * ) Notice: Subject to any disclaimer, the term of this patent is extended or adjusted under 35 U.S.C. 154(b) by 43 days.

(21) Appl. No.: 10/440,184

(22) Filed: May 19, 2003

(65) Prior Publication Data

US 2004/0231487 A1 Nov. 25, 2004

(51) Int. Cl.[7] ..... G10D 3/00
(52) U.S. Cl. ..... 84/291; 84/293; 84/267
(58) Field of Search ..... 84/291, 293, 267

(56) References Cited

U.S. PATENT DOCUMENTS 4,027,570 A * 6/1977 Rendell et al. ..... 84/293
4,056,034 A 11/1977 Kaman
4,079,654 A 3/1978 Kasha
4,172,405 A 10/1979 Kaman, II
4,317,402 A * 3/1982 McPherson, Sr. ..... 84/291
5,461,958 A 10/1995 Dresdner et al.
5,952,592 A 9/1999 Teel

* cited by examiner

*Primary Examiner*—Shih-Yung Hsieh
(74) *Attorney, Agent, or Firm*—Richard C. Litman

(57) ABSTRACT

An acoustic guitar assembly having a support system consisting of a novel shaped neck block, graphite rods and graphite ribs. The ribs are epoxied to the underside of the soundboard and originate in close proximity to one another adjacent to the neck block and fan out from there to positions along the bottom of the soundboard. The rods run from the neck into the head block and support the neck joint. The guitar has two sound holes positioned near the top of the soundboard.

11 Claims, 6 Drawing Sheets

ACOUSTIC GUITAR ASSEMBLY

BACKGROUND OF THE INVENTION

1. Field of the Invention

The present invention relates to an acoustic guitar, and more particularly to an acoustic guitar with a unique bracing system.

2. Description of Related Art

Strumming the strings of an acoustic guitar produces sound not only from the vibration of the strings, but also from the transference of those vibrations through the guitar's bridge into the soundboard. The soundboard, which is essentially a vibrating plate, has its own limitations on natural vibrating frequencies and careful design is therefore required in order to achieve the desired frequency response. Essentially, the more freely the soundboard can vibrate, the better the tone and sustain of the guitar. Unfortunately, the soundboard must be strong enough to support the tension created by the guitar strings, and some of the best soundboards are not able to support that tension without some type of support. Historically this support has come from attaching supportive bracing to the underside of the soundboard.

Soundboard bracing is often complex, difficult to construct, expensive to produce, and highly restrictive to the soundboard. For example, U.S. Pat. No. 4,056,034 to Kaman discloses a guitar in which the tension forces in the strings are reacted through a central portion of the bout where the single conventional sound hole is normally provided. The sound holes are located in the upper bout. The '034 patent can be differentiated from the present invention because the tension reacting forces of the present invention consist of graphite ribs that are curved rather than straight and extend from the bottom to the neck of the guitar. The present invention also has a reinforced neck and novel neck block.

U.S. Pat. No. 4,079,654 to Kasha discloses a bracing system for a guitar-type stringed instrument using a plurality of multidirectional braces attached to the underside of a soundboard. The '654 patent can be differentiated from the present invention in that the present invention uses a fewer number of longer curved graphite ribs which extend from the base of the guitar to the neck block. The '654 patent also does not disclose a flared neck block.

U.S. Pat. Nos. 5,461,958 and 5,952,592 disclose acoustic guitar assemblies having a bracing on the underside of the soundboard that surrounds a centrally located sound hole. The '958 and '592 patents can be distinguished from the present invention because they lack curved braces which travel from the guitar base to the neck block and they disclose centrally located sound holes which are not included in the present invention.

A second problem with prior art guitar designs is that guitar neck joints and necks are not strong enough to resist the tension created by the strings. Over time the guitar develops a warped neck or breaks at the neck joint, which is often a dovetail joint.

An example of a prior art solution to the above problems can be found in U.S. Pat. No. 4,172,405, which discloses a guitar neck that is stiffened by an adjustable rod and a rearward extending heel that connects to the guitar body. The '405 patent is distinguishable from the present invention in that the present invention includes varying lengths of graphite rods to stiffen the guitar neck as well as a traditional truss rod. The neck of the present invention is also butted directly against the neck block and epoxied, unlike traditional guitar assembly.

None of the above inventions and patents, taken either singly or in combination, is seen to describe the instant invention as claimed.

SUMMARY OF THE INVENTION

The acoustic guitar assembly is a guitar with a novel bracing system that enhances guitar tone and sustain as well as durability. The guitar assembly has a traditional soundboard with an external surface, internal surface, a top, a bottom, a left side and a right side. The soundboard is supported on its internal surface by a bracing assembly including a plurality of individual ribs. The ribs originate in a central position a few inches from the top of the soundboard and fan out into positions along the bottom end of the soundboard. There are two sound holes defined in the soundboard, one located on each side of the top of the soundboard.

The invention also includes a novel neck block. The neck block has flared top and bottom portions, and a constricted central portion. Viewed from above or below, the neck block has two parallel edges, one longer than the other. The parallel edges are connected by two arching edges. The neck block supports the neck, soundboard and backboard of the guitar.

The guitar neck is strengthened by four graphite rods. A traditional truss rod runs down the center of the neck and the graphite rods are paired on each side of the truss rod. The rods abut a novel graphite support plate at the bottom of the neck. The support plate is rectangular, is approximately the width of the neck, and is glued to the soundboard.

Accordingly, it is a principal object of the invention to provide an acoustic guitar assembly that produces superior sound quality.

It is another object of the invention to provide an acoustic guitar assembly of high strength.

It is a further object of the invention to provide an acoustic guitar assembly that is resistant to warping.

Still another object of the invention is to provide an acoustic guitar assembly that is light in weight.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
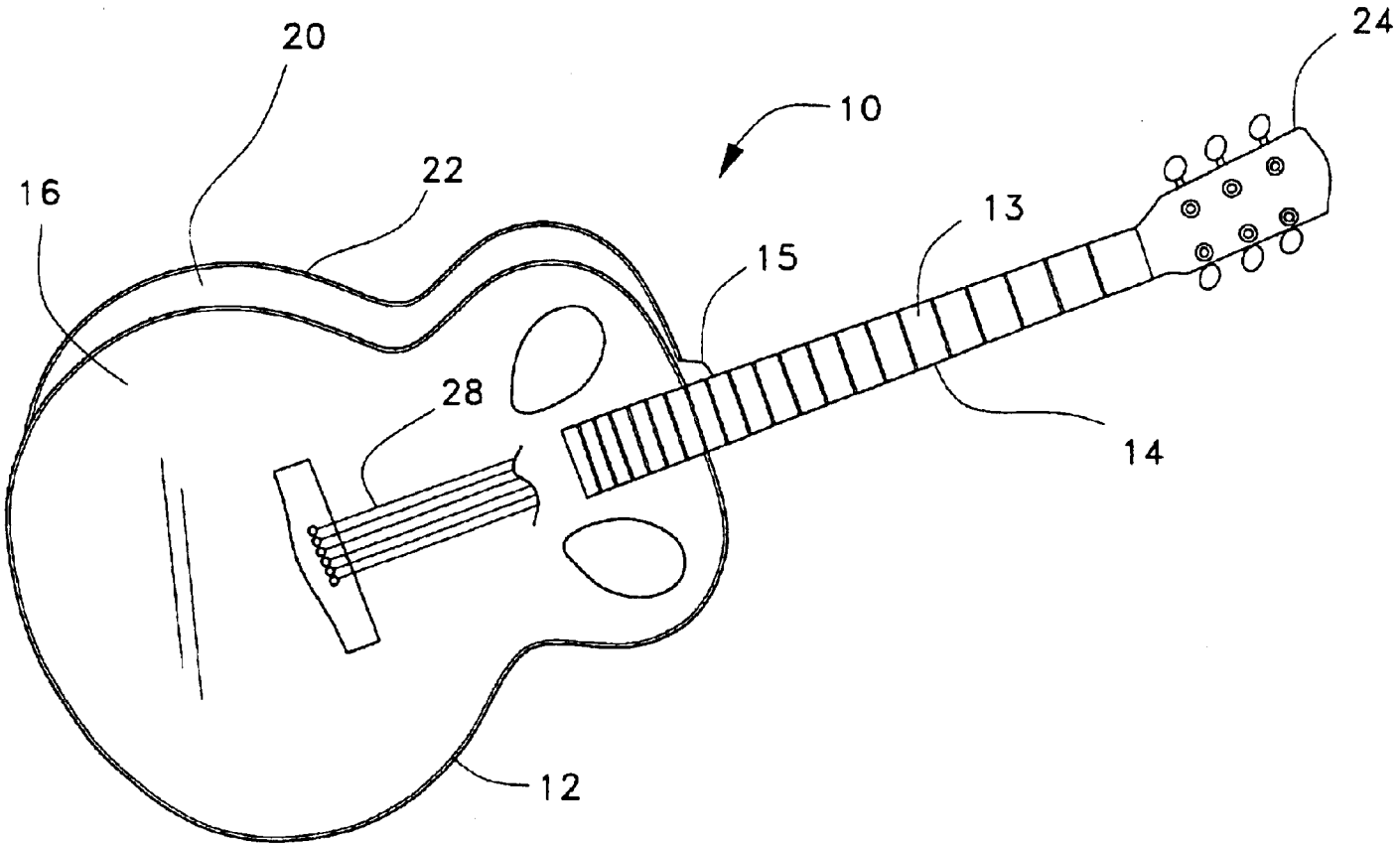
FIG. 1 is a perspective view of an acoustic guitar assembly according to the present invention, the strings being fragmented to show the neck and upper body.

Referring now to the drawings, FIG. 1 illustrates a guitar 10 constructed according to the present invention. The guitar 10 has hollow body 12 with a soundboard 16 (front surface) and backboard 22 (back surface) connected by a side wall 20. The sidewall 20 forms the top, bottom, right and left sides of the body 12. A neck 14 with a top surface, bottom surface and first and second ends is attached by its first end to a neck block 30 (discussed below) located inside the top of the body 12. The first end is enlarged so as to form a foot 15 that facilitates attachment to the neck block 30. A head stock 24 is connected to the second end of the neck 14. A fretted fingerboard 13 is attached to the top surfaces of the neck 14 and the soundboard 16.

Figure 2A:
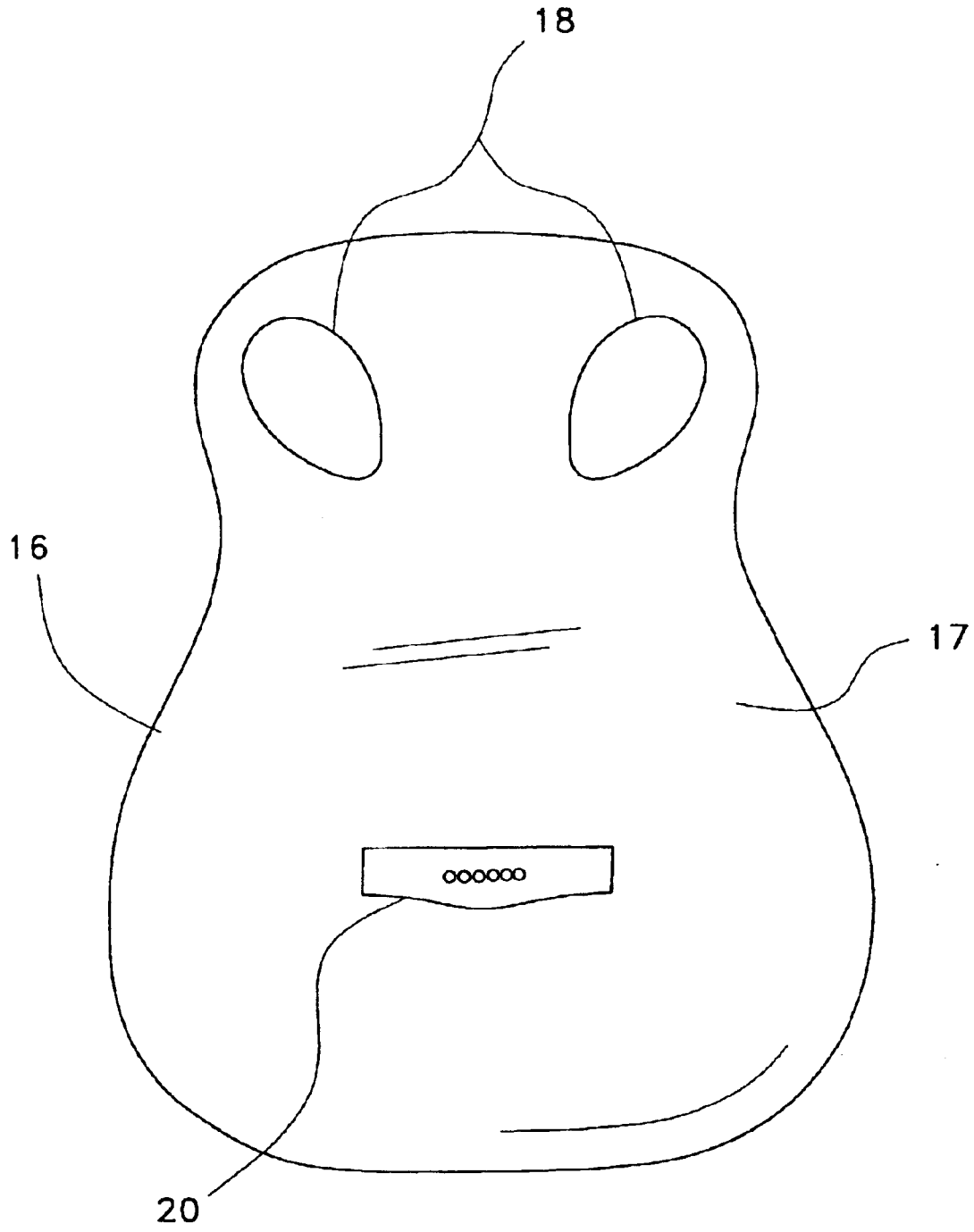
FIG. 2A is an elevational view of the front surface of a soundboard.
Figure 2B:
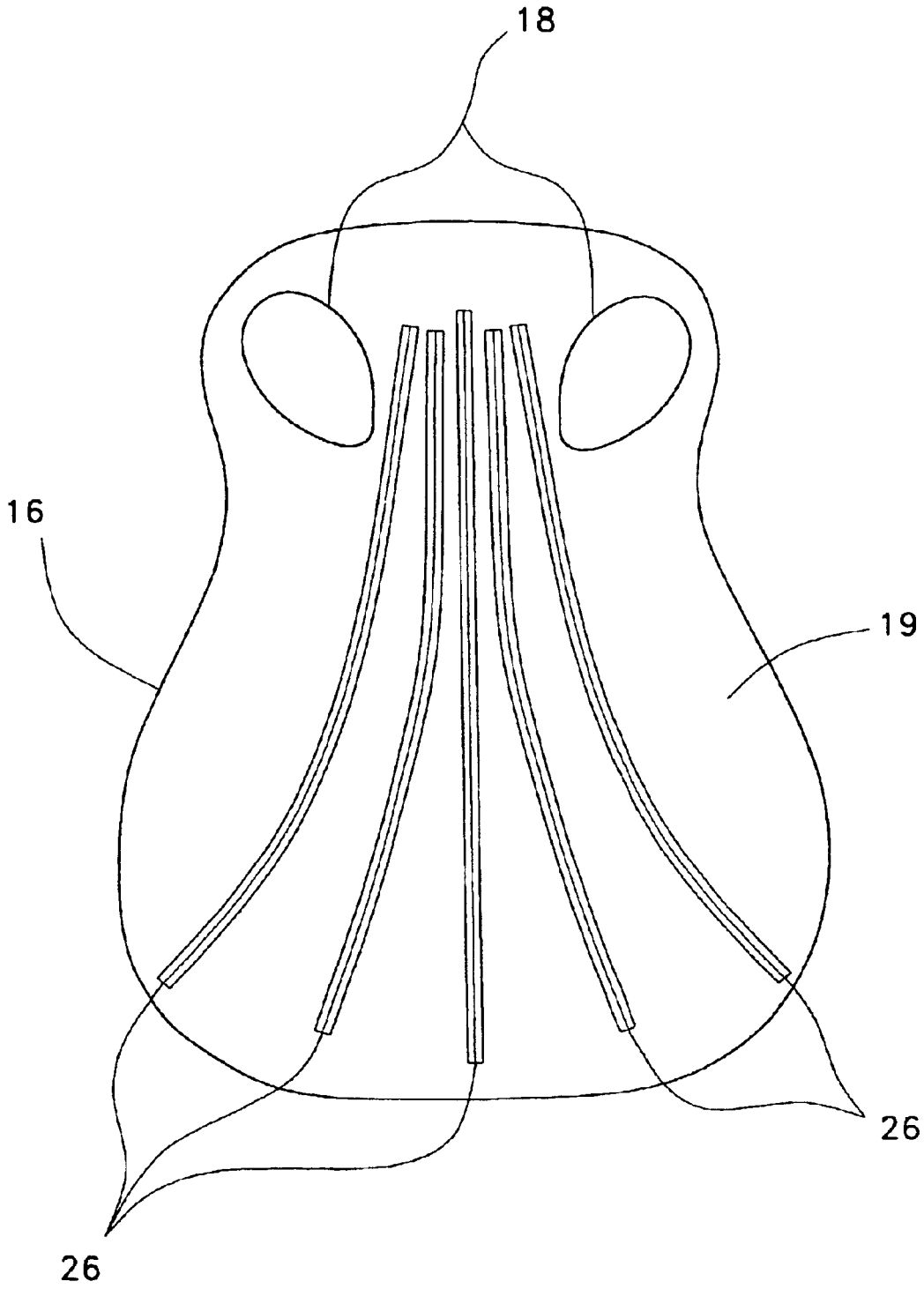
FIG. 2B is an elevational view of the back surface of a soundboard showing the bracing.

FIGS. 2A and 2B detail the front 17 and back 19 surfaces of the soundboard 16, respectively. The soundboard .16 is preferably made of wood. The soundboard 16 is approximately 0.1 to 0.12 inches thick, and has a top, a bottom, front surface 17, back surface 19 and two sides. Two generally ovoid holes 18 are defined in the top of the soundboard 16 between the front and back surfaces. The holes 18 allow sound to escape from the body 12. A tail piece 20 is attached near the bottom of front surface 17. Guitar strings (not shown) attach to the tail piece 20 at high tension and create stress on the soundboard 16.

FIG. 2B details several ribs 26 which are epoxied to the back surface 19 of the soundboard 16. The ribs 26 are triangular in cross section, pre-shaped and preferably are made of a graphite core overlaid with spruce. The ribs 26 originate in a central location near the top of the soundboard 16 and fan out to several locations near the bottom of the soundboard 16. The fan design allows the ribs 26 to brace the soundboard 16 against the stresses caused by vibration of the strings, while at the same time permitting the soundboard 16 to vibrate more freely than traditional bracing designs. The increased vibration contributes to better tone and sustain.

FIG. 2B depicts five ribs 26 disposed on the back surface 19 of the soundboard 16. Other preferred embodiments only require using three ribs 26. The five rib embodiment is used for folk guitars having steel strings. The three rib embodiment is used on classical guitars with nylon strings. Nylon strings produce less stress on the soundboard 16 than steel strings. Therefore, fewer ribs 26 are required to relieve the stress from the nylon strings.

Figure 3A:
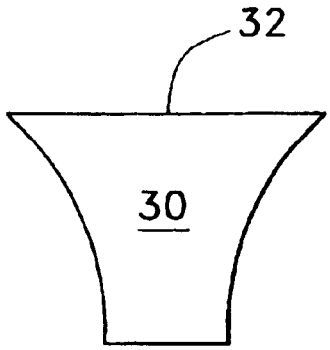
FIG. 3A is a front view of a neck block constructed according to the present invention.

FIG. 3A shows the front surface 32 of the neck block 30. The neck block 30 is preferably made of a hard wood and has a front surface that is flat with a periphery having one long edge and one short edge that are substantially parallel and which are connected by two arcuate edges. The back surface 34 of the neck block is substantially similar in shape to the front surface 32.

Figure 3B:
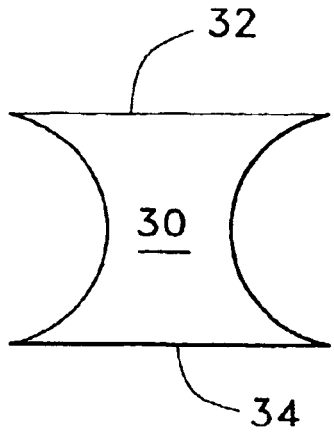
FIG. 3B is a top view of a neck block constructed according to the present invention.

FIG. 3B illustrates a top view of the neck block 30. From the top the neck block 30 resembles an hourglass in shape with flared top 32 and bottom 32 surfaces constricting to a smaller central area or isthmus.

Figure 3C:
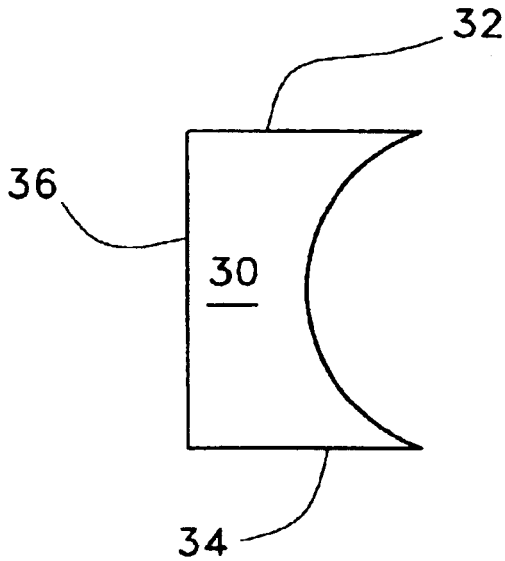
FIG. 3C is a side view of a neck block constructed according to the present invention, viewed in the same position as shown in FIG. 4.

FIG. 3C illustrates a side view of the neck block 30. From the side view, the neck block 30 has a substantially straight, flat, neck-connecting surface 36 whose front-to-back length is shorter than the top-to-bottom length of either the front surface 32 or the rear surface 34. Opposite the neck-connecting surface 36 the neck block 30 forms an inwardly sloping arch between the bottom edges of the front 32 and back 34 surfaces.

Figure 4:
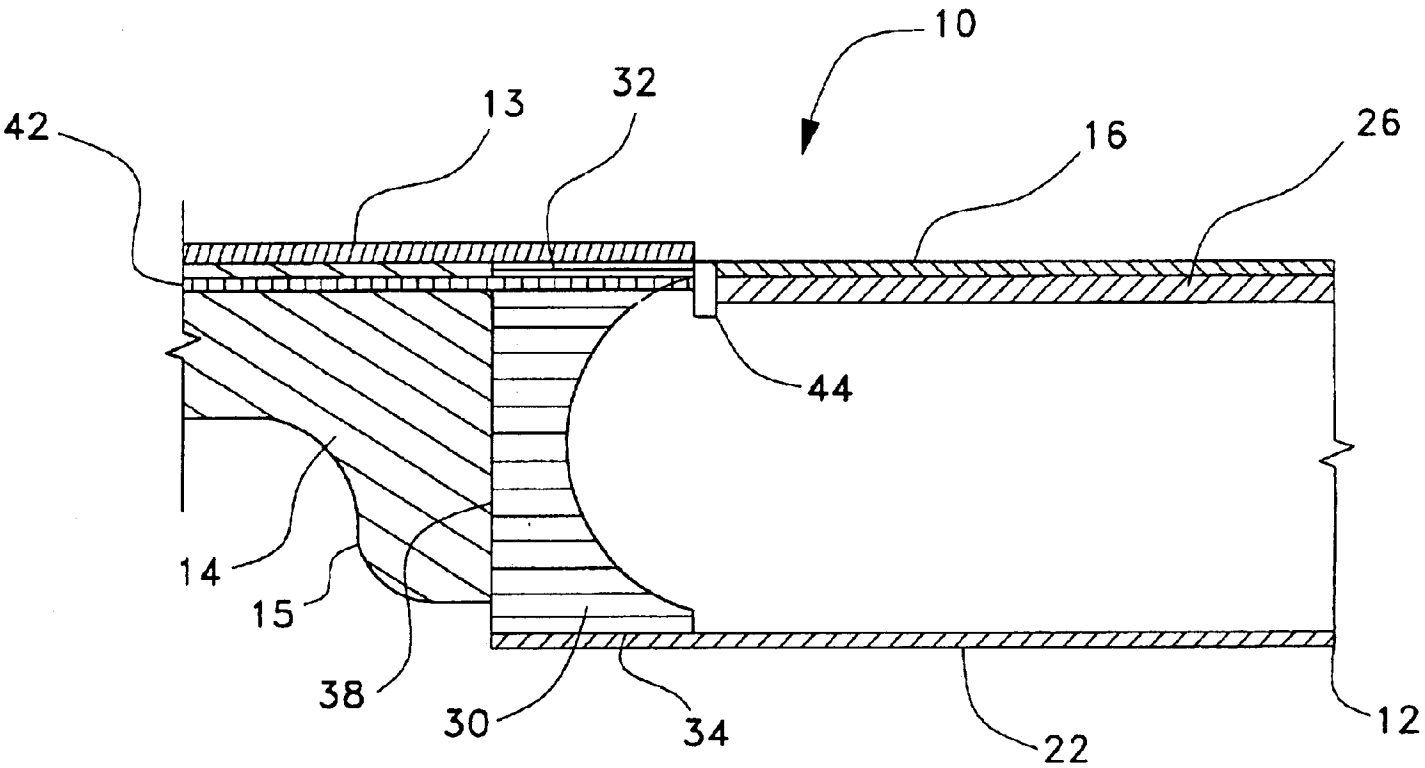
FIG. 4 is a fragmented, sectional view of a guitar constructed according to the present invention.

FIG. 4 illustrates a sectional view of a guitar 10 constructed according to the present invention. The neck block 30 is located inside the top of the body 12 with its neck-connecting surface 36 (not labeled) supporting the neck 14. The front 32 and back 34 surfaces of neck block 30 support the soundboard 16 and the backboard 22, respectively. The neck block 30 makes the body 12 rigid enough to support the neck 14 against the tension generated by the strings 28 (not shown).

Conventional guitars use a dovetail joint and glue to secure the guitar neck to the body. These joints are difficult to create and often warp or completely fail over time. Unlike conventional guitars, the neck 14 of a guitar 10 produced according to the present invention is epoxied directly to the neck block 30, thereby forming a butt-type neck joint 38. The foot 15 functions to support the neck 14 and secure the neck joint 38. Epoxy is the preferred glue due to, its resistance to humidity, its inherent strength, and its durability. The joint 38 is further strengthened by several graphite rods 42 that extend from the neck 14 into the neck block 30 and finally abut a rectangular graphite plate 44, which is epoxied to the soundboard 16. The soundboard support ribs 26 also abut the graphite plate 44.

Figure 5:
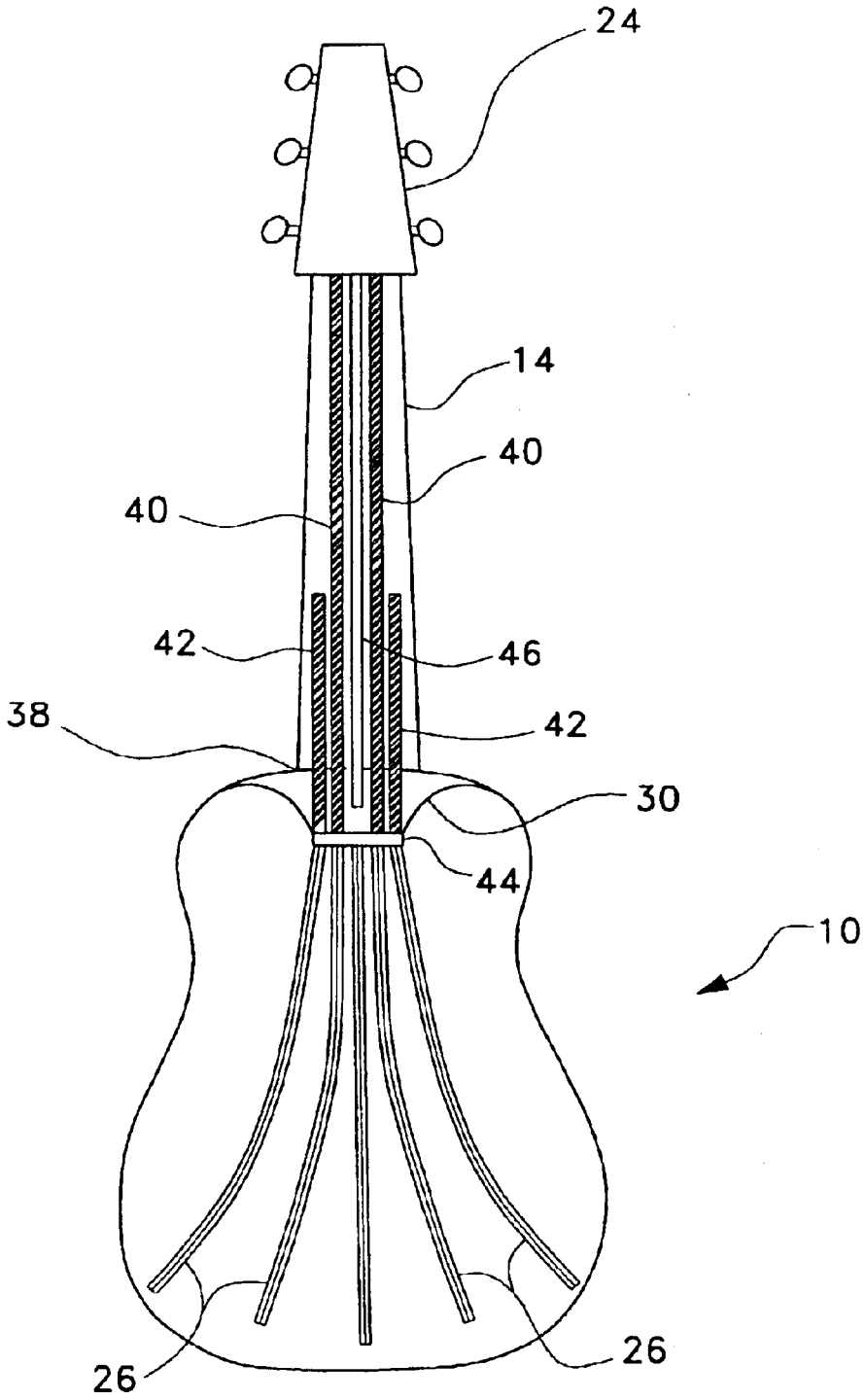
FIG. 5 is a diagrammatic view of a guitar constructed according to the present invention illustrating the bracing system.

FIG. 5 illustrates a diagrammatic view, unrestricted by a soundboard 16 or a fingerboard 13, of a guitar 10 constructed according to the present invention. Four graphite rods, two rods being short 42, and two rods being long 40, along with a traditional truss rod 46, support the neck 14 and neck joint 38. The two short rods 42 extend from the plate 44, through the neck block 30, and approximately six inches up into the neck 14. The two long rods 40 extend from the plate 44 up to the headstock 24. This arrangement of graphite ribs 26, plate 44 and rods 42, 40 produces a guitar 10 that is stronger, lighter weight, and better sounding than conventional designs.

It is to be understood that the present invention is not limited to the sole embodiment described above, but encompasses any and all embodiments within the scope of the following claims.

I claim:

1. A guitar assembly, comprising;

a soundboard having a front surface and a back surface, said soundboard having a pair of sound holes defined therein;

a backboard having a front surface and a back surface;

a sidewall disposed between said backboard and said soundboard, whereby a hollow body is formed, said body having a top end and a bottom end;

a neck block having two flared ends and a contracted central portion, said neck block being disposed between said soundboard and said backboard in the top end of said body;

an elongated neck having a first end and a second end, the first end being joined to said neck block, thereby forming a neck joint;

a plurality of ribs, said ribs being disposed in a fan formation upon the back surface of said soundboard;

at least two rods, each of the rods extending through said neck block into said neck;

a fretted fingerboard disposed on said neck;

a headstock disposed at the second end of said neck;

a tailpiece disposed on the front surface of said soundboard; and a plurality of strings extending between said tailpiece and said headstock.

2. The guitar assembly according to claim 1, wherein said ribs are triangular in section, said ribs having a graphite core and a spruce outer layer, said ribs being epoxied to said soundboard.

3. The guitar assembly according to claim 1, wherein said rods are made of graphite.

4. The guitar assembly according to claim 1, wherein said neck joint is a butt joint formed by epoxy.

5. The guitar assembly according to claim 1, wherein said neck block, said soundboard, said backboard, said sidewalls, and said neck are made of a hard wood.

6. The guitar assembly according to claim 1, wherein said plurality of strings is selected from the group consisting of steel strings and nylon strings.

7. The guitar assembly according to claim 1, wherein said plurality of strings are nylon strings.

8. The guitar assembly according to claim 7, wherein said plurality of ribs comprises three ribs.

9. The guitar assembly according to claim 1, wherein said plurality of strings are steel strings.

10. The guitar assembly according to claim 9, wherein said plurality of ribs comprises five ribs.

11. The guitar assembly according to claim 1, further comprising a graphite plate epoxied to said soundboard, said ribs and said rods abutting the graphite plate.

* * * * *